United States Patent [19]

Goizman

[11] Patent Number: 4,504,822

[45] Date of Patent: Mar. 12, 1985

[54] ELECTRIC FIELD CHANGE SENSOR EMPLOYING MAINS WIRING AS THE TRANSMITTING ANTENNA

[76] Inventor: Josif Goizman, 5455 Terrebonne Ave., Apt. 204, Montreal, Quebec, Canada

[21] Appl. No.: 335,380

[22] Filed: Dec. 29, 1981

[51] Int. Cl.[3] ..... G08B 13/26

[52] U.S. Cl. ..... 340/561; 340/310 R; 343/720

[58] Field of Search ..... 340/561, 310 R; 343/720

[56] References Cited

U.S. PATENT DOCUMENTS

| | | | |
|---|---|---|---|
| 2,355,395 | 8/1944 | Rubenstein | 340/561 |
| 4,155,078 | 5/1979 | Bowling et al. | 340/561 |
| 4,174,518 | 11/1979 | Mongeon | 340/561 |
| 4,254,413 | 3/1981 | Mongeon | 340/561 |
| 4,382,252 | 5/1983 | Ohashi et al. | 340/561 |

*Primary Examiner*—Glen R. Swann, III

*Attorney, Agent, or Firm*—Fleit, Jacobson, Cohn & Price

[57] ABSTRACT

A system for recognizing the intrusion of a conductive or semi-conductive article recognizes the intrusion of the article into an area having an ambient electric field by detecting changes in the electric field. The system basically consists of a transmitter for transmitting an electric field and a receiver for receiving the electric field and for detecting the changes in the field. The transmitter is adapted to be connected to the mains wiring whereby the ground of the mains wiring comprises the transmitting antenna of the system.

21 Claims, 14 Drawing Figures

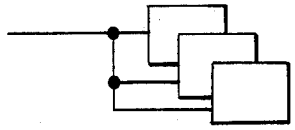
FIG. 7a
FIG. 4
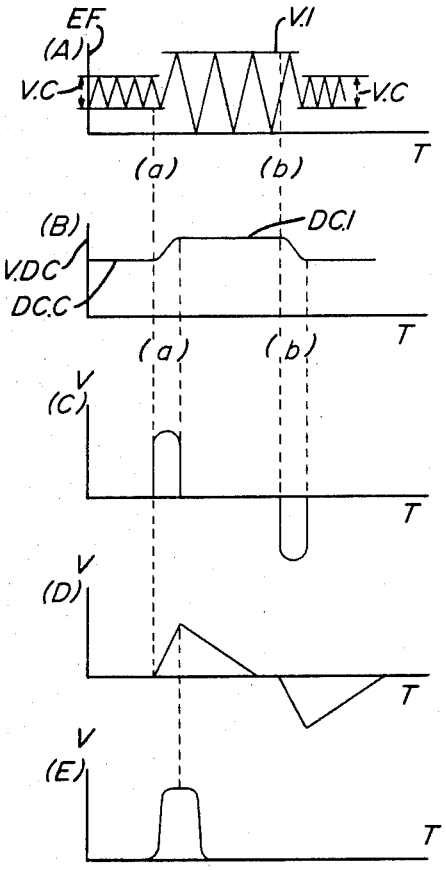
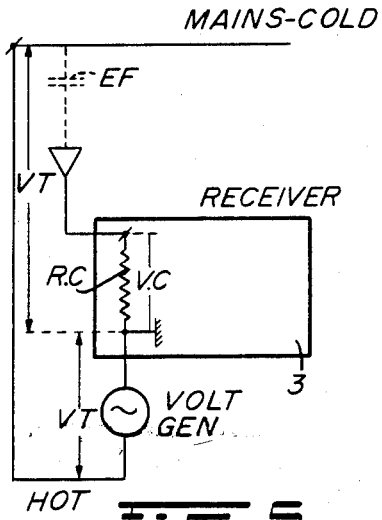
FIG. 5
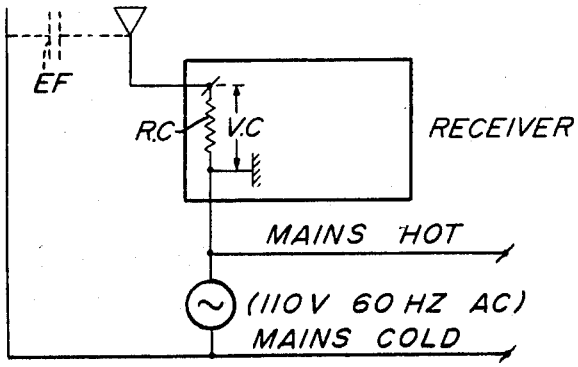
FIG. 6
FIG. 7c
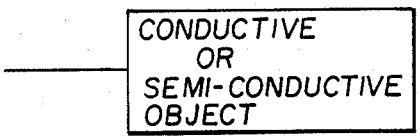
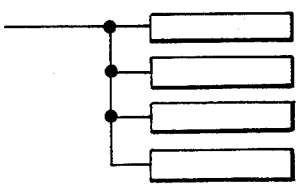
FIG. 7b

ELECTRIC FIELD CHANGE SENSOR EMPLOYING MAINS WIRING AS THE TRANSMITTING ANTENNA

BACKGROUND OF INVENTION

1. Field of the Invention

The invention relates to a system for recognizing the intrusion of a conductive or semiconductive article into an area having an ambient electric field by detecting changes in the electric field. More specifically, the invention relates to such a system which is adapted to use existing mains wiring as the transmitting antenna.

2. Description of Prior Art

Systems of the above nature are known in the art and are generally used as alarm signals in household or in industrial or commercial establishments. Examples of such systems are described in U.S. Pat. Nos. 2,355,395, Rubenstein, Aug. 8, 1944; 4,155,078, Bowling et al, May 15, 1979 and 4,254,413, Mongeon, Mar. 3, 1981.

The known systems require separate, and sometimes complicated, transmitting antennas to provide a sufficient level of electric field in the environment. Such antennas can be inconvenient as they represent another element to be hidden, and they can also be costly.

SUMMARY OF THE INVENTION

It is therefore an object of the invention to provide a system of the above-described nature which is adapted to use existing mains wiring as the transmitting antenna.

In accordance with the invention, a system for recognizing the intrusion of a conductive or semiconductive article into an area having an ambient electric field by detecting changes in the electric field, comprises: transmitter means for transmitting an electric field; and receiver means for receiving said field and for detecting changes therein; characterized in that said transmitter means is adapted to be connected to said mains wiring whereby said mains wiring comprises the transmitting antenna of said system.

As will be appreciated, such a system will detect the intrusion of either animate or inanimate objects.

In detecting animate objects, such a system could, of course, be used as an alarm system.

BRIEF DESCRIPTION OF DRAWINGS

The invention will be better understood by an examination of the following description, together with the accompanying drawings, in which:

FIGS. 4A to 4E are graphs useful in understanding the operation of the inventive device;

FIG. 5 illustrates the nature of the electric field in the FIG. 1 embodiment; and FIG. 6 illustrates the nature of the electric field in the FIG. 3 embodiment.

FIGS. *7a, 7b* and *7c* illustrate metal foil sheets, metal foil strips and schematically show conductive or semiconductive objects, respectively, as the means for sensing.

DESCRIPTION OF PREFERRED EMBODIMENTS

Figure 1:
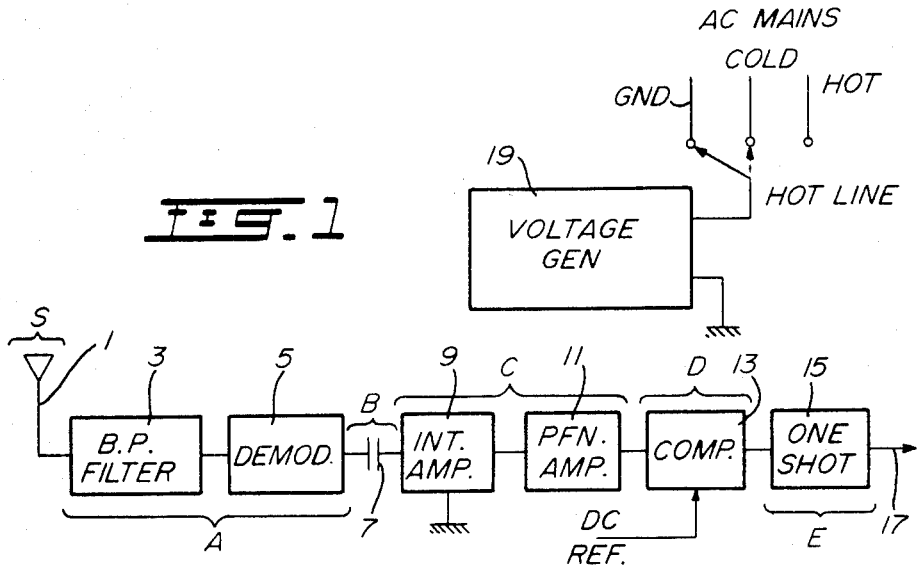
FIG. 1 is a somewhat schematic block diagram of one embodiment of the invention.

Turning now to FIG. 1 of the drawings, a system in accordance with the invention includes a receiving means consisting of a means for sensing an electric field in the environment and for providing an electric signal representative of the field.

Figure 1A:
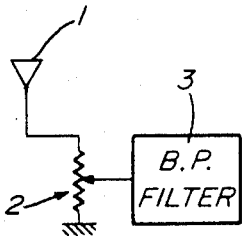
FIG. 1A illustrates alternative means which can be used as the sensor S illustrated in FIG. 1.

The system also includes a band pass filter 3, a demodulator 5, a differentiator 7, an integrator amplifier 9, a pulse forming network and amplifier 11, a comparator 13 and an initiating means 15. All of these elements will be discussed below. To provide sensitivity adjustment at the input, a potentiometer 2 can be inserted in the circuit as shown in FIG. 1A.

In the FIG. 1 embodiment, an electric field is generated by the voltage generator 19. The field could be produced by the mains as per the FIG. 3 embodiment also discussed below.

Figure 3:
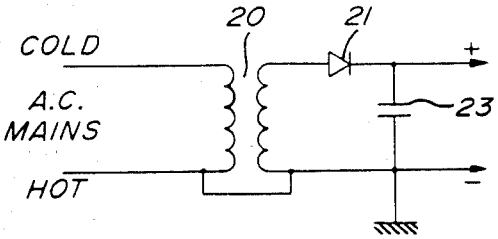
FIG. 3 illustrates the mains hook-up when the normal 60 Hz supply is used to produce an electric field.

As shown in FIG. 1, when a voltage generator is used to generate the field, the hot line of the voltage generator would be fed either to the ground or to the cold line of the AC mains. The question of which line it is fed to depends on whether or not the establishment has 3-pronged plugs or 2-pronged plugs. When it uses 3-pronged plugs, the hot line of the voltage generator will be fed to the ground of the mains. When there are 2-pronged plugs, the hot line will be fed to the cold line of the AC mains. The cold of the voltage generator in either case is connected to the ground of the receiver. When the AC mains are used to produce the electric field, then the hot line of the mains is fed to the ground of the system as shown in FIG. 3. The mains will also supply the DC for operating the system by passing the output of the mains through a rectifier circuit, for example, transformer 20, diode 21 and capacitor 23. As a safety measure, with this embodiment, the entire system should be housed in a plastic box. In addition, a large valued resistor should be inserted in series between the input antenna 1 and the bandpass filter 3.

Returning to FIG. 1, by connecting the output of the voltage generator to the cold or ground line of the AC mains, this line is used as a radiator to radiate the electric field. As will be appreciated, the ground of the mains will normally be connected to the plumbing of the establishment. In addition, appliances, such as a refrigerator, a stove, etc., will also be grounded to the ground of the mains. Thus, not only the lines of the mains, but also the plumbing and the appliances will be radiating the electric field in this embodiment.

Generally speaking, the voltage measured by the receiving system is the voltage $V_C$(FIG. 5) which exists between the input antenna and the ground of the receiver. Because the generator ground is connected to the receiving system ground, another part of the total voltage EF exists between the radiating element and the input antenna. Thus, $V_C$, detected by this arrangement, is representative of a more intense field.

In the same way, and considering FIG. 6, the electric field detected by the FIG. 3 embodiment is the field between the input antenna and ground or cold mains. As the hot line of the mains is connected to the ground of the receiving system, the electric field intensity between the input antenna and ground or cold mains is the same as the electric field intensity between the radiating element and the input antenna. $V_C$, the voltage at the input, is once again a voltage representative of a higher intensity electric field.

Turning to FIG. 1A, the means 1 is illustrated as an antenna, but it is contemplated, in accordance with the invention, that the "antenna" need not be an antenna as understood in the general sense of the word, that is, a wire or the like. Instead, and preferably, and as illustrated in dotted lines in FIG. 1A, the means for sensing would constitute either sheets (as illustrated in FIG. 7*a*) or strips of metal foil (as illustrated in FIG. 7*b*) or any conductive or semi-conductive object such as a filing cabinet, a safe, a plant, etc. (as illustrated schematically in FIG. 7*c*). The sheets or strips could then be placed under rugs or the like so that they would not be immediately visible to an intruder.

The output of the means for sensing is fed to a means A for converting electric field amplitude to a DC level. In FIG. 1, the means A consists of a bandpass filter 3 and a demodulator 5.

As will be appreciated, changes in electric field will be converted to changes in the DC level by the means A. To convert the changes in DC level to a pulse, differentiator means B is provided. In FIG. 1, these means comprise a capacitor 7.

Although the bandpass filter, as will be seen below, will eliminate a good deal of the noise, interference and spurious signals in the environment, nevertheless, there will be some residual false signals which will be passed by the bandpass filter. In order to further reduce this content, and to thereby permit the device to be made more sensitive to true signals of intruders, a circuit means C is provided. The circuit means C, in a preferred embodiment, consists of an integrator 9 and a pulse forming network 11.

The device also includes a comparing means D illustrated as a comparator 13, and an initiating means E illustrated as a one-shot multivibrator 15. When the voltage generator 19 is used, the frequency of the voltage generator would be in the audio range, and the bandpass filter would be closely centered on the frequency of the voltage generator. When the field produced by the mains is used, then the bandpass filter would be centered closely on 60 Hz, or a low pass filter could be used.

In operation, the illustrated device operates as follows:

Referring to FIGS. 4A to 4E, the ambient electric field will produce a level $V_C$ as shown in FIG. 4A. When an intruder intrudes into the area monitored by the device, the level of the electric field will increase to a level $V_I$.

The action of the bandpass filter will eliminate a good deal of the signals at frequencies other than the frequency of the electric fields, and the demodulator will then eliminate the AC part of the signal so that a DC level will be produced at the input to the capacitor 7. As seen in FIG. 4B, the ambient electric field will produce a DC level $DC_C$, while the presence of the intruder will produce a DC level $DC_I$.

Although the bandpass filter will eliminate a proportion of the noise, interference and spurious signals of the environment, some of the false signals will get through past the first and second stages A and B either because they are of a frequency that will be passed by the bandpass filter, or because they will completely bypass the first two stages. In order to further eliminate such unwanted signals, the output of the capacitor 7 is integrated to provide an output as shown in FIG. 4D, and the output of the integrator is fed to a pulse forming network which provides an output as shown in FIG. 4E.

To understand how the stage C operates, we must first appreciate that, any increase in the level of the electric field due to an intruder is not instantaneous. Instead, as best shown in FIG. 4B, the signal rises with a positive slope and falls with a negative. The rises and falls will produce pulses at the output of the capacitor as shown in FIG. 4C.

Stage C will have the effect of eliminating narrow pulses such as spikes of noise, interference or spurious signals.

The output of stage C is fed to a comparator, and the second input of the comparator is connected to a DC reference level. Preferably, the DC level is adjustable so as to adjust the sensitivity of the device. As is well known, when the output of stage C exceeds the DC reference level to the comparator, an output will be provided by the comparator. This is fed to an initiating terminal of a one-shot multivibrator 15, and the output of the multivibrator is fed, via conductive means 17, to a relay or the like. When the system is used as a system for monitoring households or commercial or industrial establishments against the invasion of unwanted intruders, then the contacts of the relay could be connected to a ringing alarm or to a police station as is well known in the art.

The device could also be used in, for example, industrial processes to detect the presence of conductive or semi-conductive objects at a given stage or stages in the process. In such a case, the relay contacts could be fed to a mechanism for controlling the process, or it could be fed to a supervisory station to thereby provide a signal to the supervisor to take appropriate action.

Figure 2:
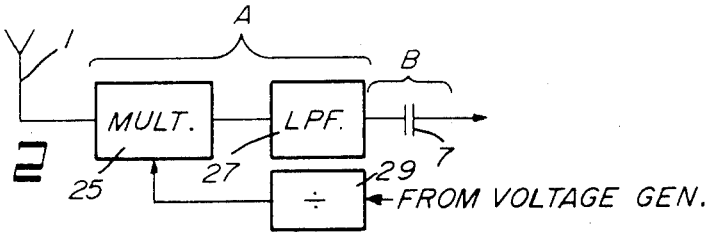
FIG. 2 illustrates a specific circuit for converting electric field level to a DC level, different from the circuitry illustrated in FIG. 1.

In the case when a voltage generator is used to produce the electric field, the stage A can be replaced by the arrangement as shown in FIG. 2. As can be seen, this consists of a multiplier 25 and a low pass filter 27. One input of the multiplier is connected to the means for sensing 1, and the other input is connected to an output terminal of the voltage generator through a divider and phase shifter 29. The output of the multiplier will contain signals at the frequency of the voltage generator as well as multiples of this frequency. The low pass filter will eliminate all frequencies above and including the second harmonic of the product. Accordingly, the stage A as illustrated in FIG. 2 operates as a coherent amplitude demodulator.

In a particular embodiment, an LM 3900 consisting of four operational amplifiers, was used for providing the circuits 9, 11, 13 and 15 by connecting the respective amps as an integrator, pulse forming network, comparator and one shot multivibrator, respectively. A simple diode was used as a demodulator.

Although several embodiments have been above-described, this was for the purpose of illustrating, but not limiting the invention. Various modifications which will come readily to the mind of one skilled in the art are within the scope of the invention as defined in the appended claims.

I claim:

1. A system for recognizing the intrusion of a conductive or semi-conductive object into an area, said area having a mains wiring by detecting changes in an ambient electric field, said system comprising;

transmitter means comprising a transmitting antenna for establishing said electric field; and receiver means, having a ground (minus DC) for monitoring said field and for detecting changes therein;

said transmitter means being adapted to be connected to said mains wiring whereby said mains wiring comprises the transmitting antenna of said system;

said mains wiring having a cold line, a hot line and a ground line, and wherein said system has a ground, said transmitter means including:

voltage generator means having a hot line and a cold line;

the hot line of said voltage generator means being fed to the ground line of said mains;

the cold line of said voltage generator means being fed to the ground of said receiver means.

2. A system as defined in claim 1 wherein said receiver means comprises:

means for sensing the electric field and changes therein and for providing an electric signal representative of said electric field and said changes;

means for converting said electric signal to a DC level proportional to the amplitude of said electric signals;

differentiator means for converting a change in said DC level to a pulse having an amplitude proportional to the extent of change in said DC level; and circuit means for suppression of noise, interference and spurious signals.

3. A system as defined in claim 2 wherein said circuit means comprises integrator means and a pulse forming network.

4. A system as defined in claim 2 wherein said means for sensing comprises receiving antenna means.

5. A system as defined in claim 2 wherein said means for sensing comprises sheets of metal foil.

6. A system as defined in claim 2 wherein said means for sensing comprises strips of metal foil.

7. A system as defined in claim 2 wherein said means for converting comprises a bandpass or low pass filter receiving an output from said means for sensing, and a demodulator receiving an output from said bandpass or low pass filter.

8. A system as defined in claim 2 wherein said means for converting said electric signal comprises a multiplier having a first input terminal, a second input terminal, and an output terminal;

said first input terminal being connected to said means for sensing;

said second input terminal being connected to an output of said voltage generator means.

9. A system as defined in claim 8 wherein said means for converting said electric signal further includes a low pass filter, the output terminal of said frequency multiplier being connected to an input of said low pass filter.

10. A system as defined in claim 2 wherein said differentiator means for converting a change in said DC level to a pulse comprises a capacitor.

11. A system as defined in claim 2 and further comprising comparator means for comparing the output of said cicuit means with a reference DC level;

initiating means connected to the output of said comparator;

said comparator being adapted to provide an output signal when the output of the circuit means exceeds said DC level;

said means for initiating being adapted to initiate an alarm on receipt of an output signal from said comparator.

12. A system as defined in claim 11 wherein said receiver means comprises:

means for sensing the electric field and changes therein and for providing an electric signal representative of said electric field and said changes;

means for converting said electric signal to a DC level proportional to the amplitude of said electric signals;

means for converting a change in said DC level to a pulse having an amplitude proportional to the extent of change in said DC level; and circuit means for suppression of noise, interference and spurious signals.

13. A system as defined in claim 12 wherein said circuit means comprises integrator means and a pulse forming network.

14. A system as defined in claim 12 wherein said means for sensing comprises receiving antenna means.

15. A system as defined in claim 12 wherein said means for sensing comprises sheets of metal foil.

16. A system as defined in claim 12 wherein said means for sensing comprises strips of metal foil.

17. A system as defined in claim 12 wherein said means for converting comprises a bandpass or low pass filter receiving an output from said means for sensing, and a demodulator receiving an output from said bandpass or low pass filter.

18. A system as defined in claim 12 wherein said means for converting a change in said DC level to a pulse comprises a capacitor.

19. A system as defined in claim 12 and further comprising comparator means for comparing the output of said circuit means with a reference DC level;

initiating means connected to the output of said comparator;

said comparator being adapted to provide an output signal when the output of the circuit means exceeds said DC level;

said means for initiating being adapted to initiate an alarm or the like on receipt of an output signal from said comparator.

20. A system as defined in claim 12 wherein said means for sensing comprises any conductive or semiconductive object.

21. A system as defined in claim 2 wherein said means for sensing comprises any conductive or semiconductive object.

* * * * *